US012805631B2

(12) United States Patent
Chen et al.

(10) Patent No.: US 12,805,631 B2
(45) Date of Patent: Nov. 24, 2026

(54) SLIDE RAIL ASSEMBLY

(71) Applicants: King Slide Works Co., Ltd., Kaohsiung City (TW); King Slide Technology Co., Ltd., Kaohsiung City (TW)

(72) Inventors: Ken-Ching Chen, Kaohsiung City (TW); Shun-Ho Yang, Kaohsiung City (TW); Chun-Yi Ho, Kaohsiung City (TW); Chun-Chiang Wang, Kaohsiung City (TW)

(73) Assignees: King Slide Works Co., Ltd., Kaohsiung City (TW); King Slide Technology Co., Ltd., Kaohsiung City (TW)

( * ) Notice: Subject to any disclaimer, the term of this patent is extended or adjusted under 35 U.S.C. 154(b) by 53 days.

(21) Appl. No.: 18/980,633

(22) Filed: Dec. 13, 2024

(65) Prior Publication Data

US 2025/0386931 A1 Dec. 25, 2025

(30) Foreign Application Priority Data

Jun. 19, 2024 (TW) ..... 113122858

(51) Int. Cl.
*A47B 88/45* (2017.01)

(52) U.S. Cl.
CPC ..... *A47B 88/45* (2017.01); *A47B 2210/0064* (2013.01)

(58) Field of Classification Search
CPC ..... A47B 88/45; A47B 2210/0064
USPC ..... 312/334.8
See application file for complete search history.

(56) References Cited

U.S. PATENT DOCUMENTS

| | | | | |
|---|---|---|---|---|
| 3,039,838 | A * | 6/1962 | Koch, Jr. | A47B 88/493 188/38 |
| 5,085,523 | A * | 2/1992 | Hobbs | A47B 88/57 384/21 |
| 5,181,782 | A * | 1/1993 | Wojcik | A47B 88/467 312/334.44 |
| 6,457,790 | B1 * | 10/2002 | Liang | A47B 88/493 312/334.46 |
| 6,764,149 | B2 * | 7/2004 | Jurja | A47B 88/57 312/334.46 |
| 6,789,862 | B2 * | 9/2004 | Shih-Long | A47B 88/49 312/334.46 |
| 6,935,710 | B2 * | 8/2005 | Chen | A47B 88/487 312/334.44 |
| 7,357,468 | B2 * | 4/2008 | Hwang | A47B 88/49 312/334.47 |

(Continued)

FOREIGN PATENT DOCUMENTS

| | | |
|---|---|---|
| CN | 219331097 U | 7/2023 |
| EP | 3644695 A1 | 4/2020 |

(Continued)

*Primary Examiner* — Daniel J Troy
*Assistant Examiner* — Timothy M Ayres
(74) *Attorney, Agent, or Firm* — Best & Flanagan LLP

(57) ABSTRACT

A slide rail assembly includes two slide rails. During a process of a first one of the two slide rails being moved relative to a second one of the two slide rails along a predetermined direction, a first predetermined feature and a second predetermined feature are configured to contact each other to provide resistance in order to slow down the relative movement between the two slide rails.

5 Claims, 13 Drawing Sheets

(56) References Cited

U.S. PATENT DOCUMENTS

| | | | | |
|---|---|---|---|---|
| 7,520,577 | B2 * | 4/2009 | Chen | A47B 88/493 312/334.46 |
| 9,211,003 | B1 * | 12/2015 | Chen | H05K 7/1489 |
| 10,342,341 | B2 * | 7/2019 | Chen | A47B 88/57 |
| 10,428,872 | B2 * | 10/2019 | Kuribayashi | F16C 29/00 |
| 10,568,426 | B1 | 2/2020 | Chen et al. | |
| 10,617,208 | B2 * | 4/2020 | Chen | F16C 29/12 |
| 12,419,417 | B2 * | 9/2025 | Chen | H05K 7/1489 |
| 2020/0405053 | A1 * | 12/2020 | Park | A47B 88/477 |

FOREIGN PATENT DOCUMENTS

| | | | |
|---|---|---|---|
| JP | S58-47248 | U | 3/1983 |
| JP | 3984186 | B2 | 10/2007 |

* cited by examiner

SLIDE RAIL ASSEMBLY

BACKGROUND OF THE INVENTION

1. Field of the Invention

The present invention relates to a slide rail mechanism, and more particularly, to a slide rail assembly capable of providing resistance to stop or slow down movement of a rail moving relative to another rail along a predetermined direction.

2. Description of the Prior Art

China patent publication number CN 219331097U discloses a ball slide rail with a buffering anti-rebound mechanism, which comprises an outer slide rail, an inner slide rail, and a middle slide rail arranged between the outer slide rail and the inner slide rail. A limiting mechanism is provided between the outer slide rail and the middle slide rail, and between the inner slide rail and the middle slide rail. The patent is characterized in that a first blocking mechanism with buffering anti-rebound function is arranged between the outer slide rail and the middle slide rail, and a second blocking mechanism with buffering anti-rebound function is arranged between the inner slide rail and the middle slide rail.

SUMMARY OF THE INVENTION

The present invention provides a slide rail assembly capable of providing resistance to stop or slow down movement of a rail moving relative to another rail along a predetermined direction.

According to an embodiment of the present invention, a slide rail assembly comprises an outer rail, a middle rail and an inner rail. The middle rail is movable relative to the outer rail. The inner rail is movable relative to the middle rail. The middle rail is movably mounted between the outer rail and the inner rail. A predetermined one of the inner rail and the middle rail is arranged with a first predetermined feature, and the outer rail is arranged with a second predetermined feature. During a process of the predetermined one of the inner rail and the middle rail being moved along a predetermined direction relative to the outer rail, the first predetermined feature and the second predetermined feature are configured to contact each other in order to slow down movement of the predetermined one of the inner rail and the middle rail along the predetermined direction relative to the outer rail. The slide rail assembly further comprises a synchronization mechanism configured to allow the inner rail and the middle rail to be synchronously moved along the predetermined direction relative to the outer rail.

According to another embodiment of the present invention, the slide rail assembly comprises a first rail and a second rail longitudinally movable relative to each other. The first rail is arranged with a first predetermined feature, and the second rail is arranged with a second predetermined feature. During a process of the first rail being moved along a predetermined direction relative to the second rail, the first predetermined feature and the second predetermined feature are configured to contact each other in order to slow down movement of the first rail along the predetermined direction relative to the second rail.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
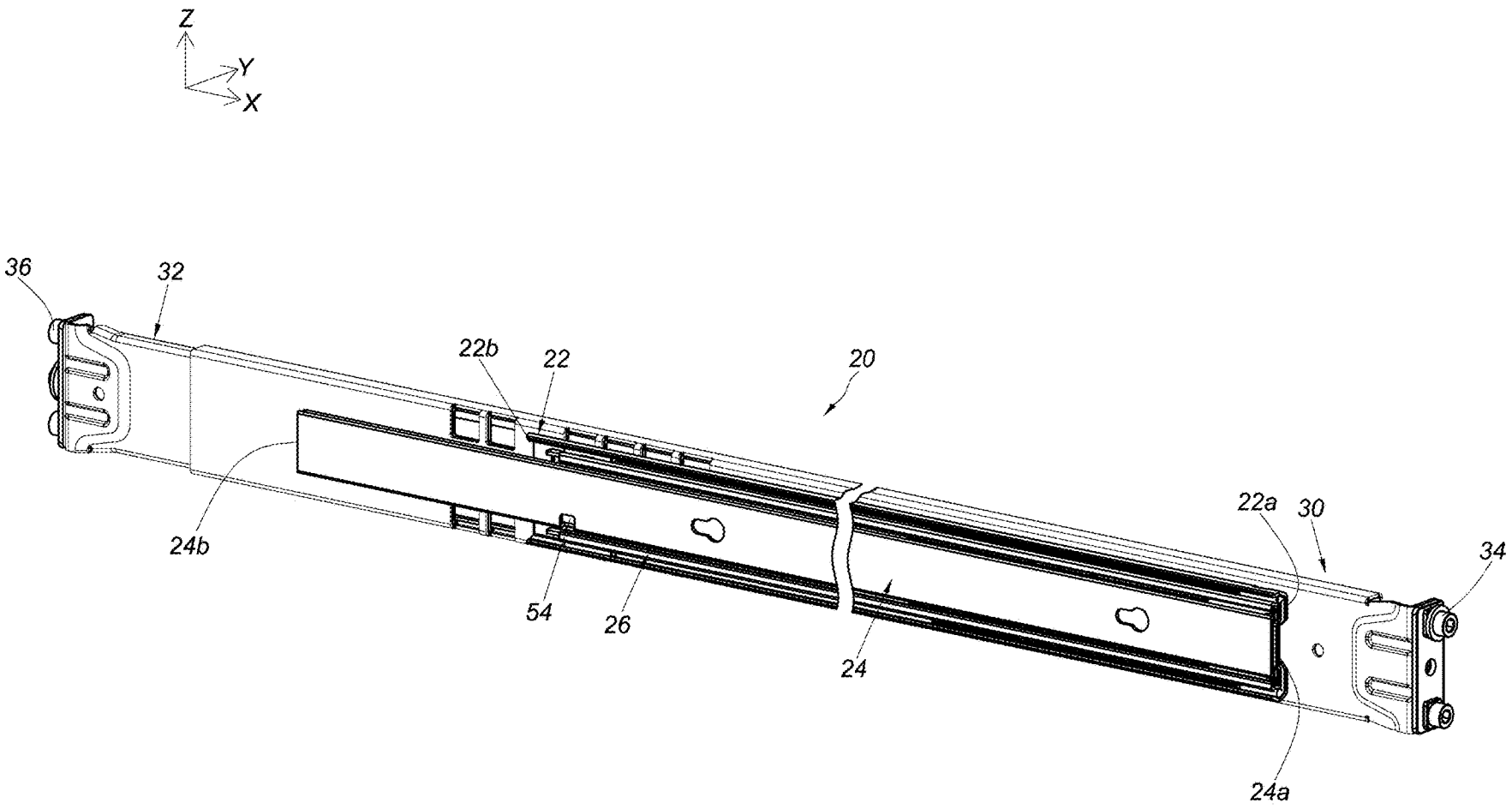
FIG. 1 is a diagram showing a slide rail assembly according to a first embodiment of the present invention.
Figure 2:
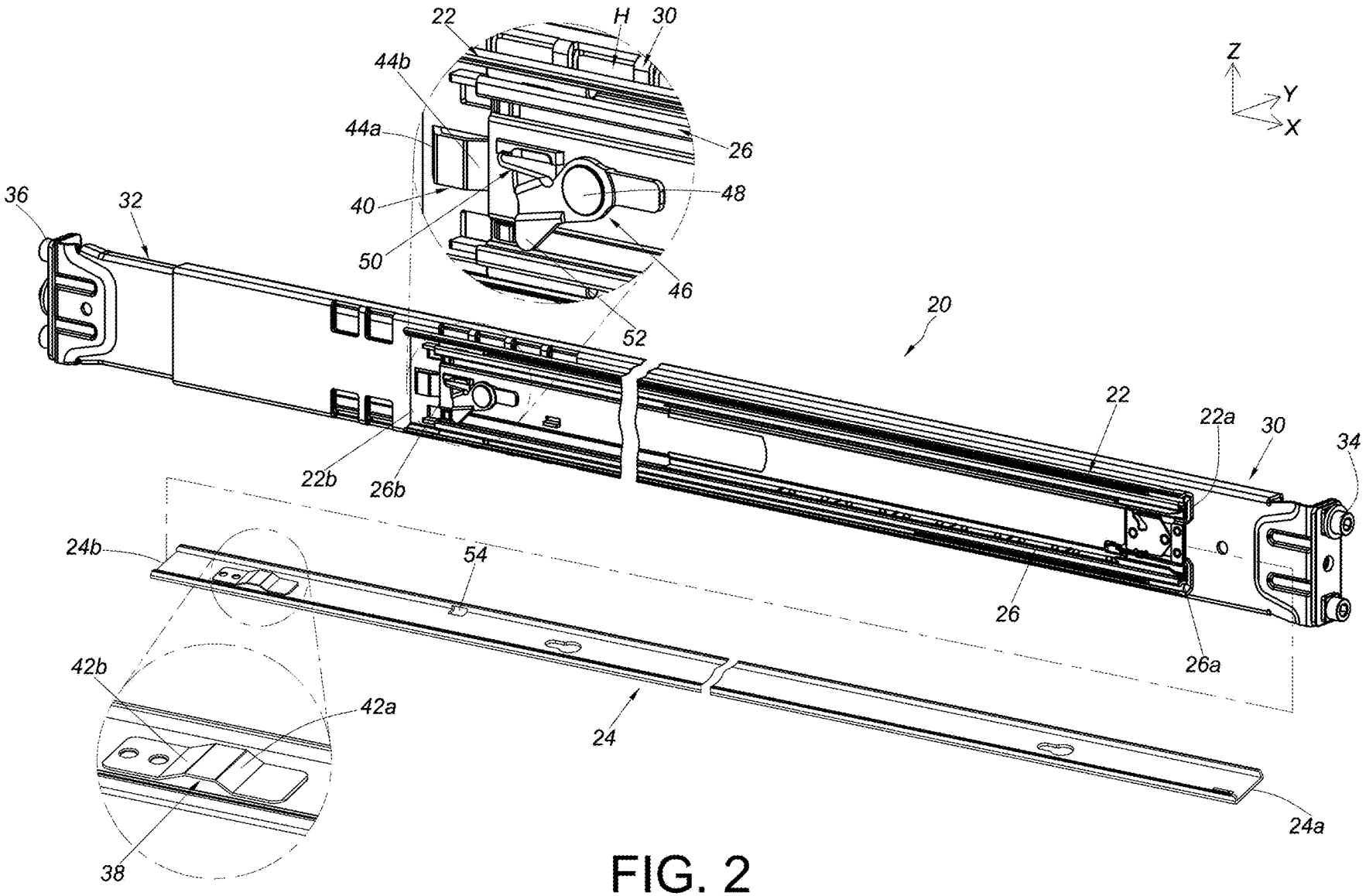
FIG. 2 is an exploded view of the slide rail assembly comprising an outer rail, a middle rail and an inner rail according to the first embodiment of the present invention.

As shown in FIG. 1 and FIG. 2, a slide rail assembly 20 comprises at least two slide rails according to a first embodiment of the present invention. In the present embodiment, the slide rail assembly 20 is a three-section slide rail assembly. Specifically, the slide rail assembly 20 comprises an outer rail 22, an inner rail 24 and a middle rail 26 movably mounted between the outer rail 22 and the inner rail 24. The outer rail 22, the inner rail 24 and the middle rail 26 are longitudinally movable relative to each other. In the present embodiment, the X axis is a longitudinal direction (or a length direction or a moving direction of the slide rail), the Y axis is a transverse direction (or a lateral direction of the slide rail), and the Z axis is a vertical direction (or a height direction of the slide rail).

Preferably, the slide rail assembly 20 further comprises a first bracket 30 (such as a front bracket) and a second bracket 32 (such as a rear bracket) mounted to a back side of the outer rail 22. The first bracket 30 and the second bracket 32 are longitudinally movable relative to each other. The outer rail 22 is configured to be mounted to a rack through first mounting members 34 of the first bracket 30 and second mounting members 36 of the second bracket 32. Preferably, at least one of the first bracket 30 and the second bracket 32 is formed with at least one ventilation hole H. In the present embodiment, the first bracket 30 and/or the second bracket 32 is formed with a plurality of ventilation holes H, but the present invention is not limited thereto. In addition, the inner rail 24 is configured to carry a carried object (such as an electronic device). The ventilation holes H of the first bracket 30 or the second bracket 32 are configured to dissipate heat from the carried object.

One of the inner rail 24 and the middle rail 26 is arranged with a first predetermined feature 38. In the first embodiment, the inner rail 24 is arranged with the first predetermined feature 38. On the other hand, the outer rail 22 is arranged with a second predetermined feature 40 configured to interact with the first predetermined feature 38. The first predetermined feature 38 has a first guiding surface 42*a* and a second guiding surface 42*b* opposite to each other. Preferably, each of the first guiding surface 42*a* and the second guiding surface 42*b* can be an inclined surface or an arc surface. Similarly, the second predetermined feature 40 has a first guiding structure 44*a* and a second guiding structure 44*b* opposite to each other. Preferably, each of the first guiding structure 44*a* and the second guiding structure 44*b* has an inclined surface or an arc surface. Preferably, at least one of the first predetermined feature 38 and the second predetermined feature 40 is a protrusion. In the present embodiment, both the first predetermined feature 38 and the second predetermined feature 40 are protrusions, but the present invention is not limited thereto. The first predetermined feature 38 can be integrally formed on the inner rail 24 or can be an additional component connected to the inner rail 24. In the present embodiment, the first predetermined feature 38 is an additional component (such as an elastic piece) connected to the inner rail 24. Similarly, the second predetermined feature 40 can be integrally formed on the outer rail 22 or can be an additional component connected to the outer rail 22. In the present embodiment, the second predetermined feature 40 is a protrusion integrally formed on the outer rail 22.

In addition, the slide rail assembly 20 further comprises a synchronization mechanism. The synchronization mechanism comprises an auxiliary member 46 movably mounted on the middle rail 26. Preferably, the auxiliary member 46 is pivotally connected to the middle rail 26 through a shaft 48, and an elastic member 50 is configured to provide an elastic force to the auxiliary member 46. The elastic member 50 is an elastic piece or a spring, but the present invention is not limited thereto. The auxiliary member 46 comprises an auxiliary part 52 configured to interact with a working feature 54 of the inner rail 24, such that the inner rail 24 and the middle rail 26 can be synchronously moved relative to the outer rail 22. The working feature 54 can a hole defined by a plurality of walls on the inner rail 24, but the present invention is not limited thereto.

Each of the outer rail 22, the middle rail 26 and the inner rail 24 has two opposite end parts, such as a front end part and a rear end part. Specifically, the outer rail 22 has a first end part 22*a* and a second end part 22*b*, the middle rail 26 has a first end part 26*a* and a second end part 26*b*, and the inner rail 24 has a first end part 24*a* and a second end part 24*b*.

Preferably, the first predetermined feature 38 is located adjacent to the second end part 24*b* of the inner rail 24, and the second predetermined feature 40 is located adjacent to the second end part 22*b* of the outer rail 22.

Preferably, the auxiliary member 46 is located adjacent to the second end part 26*b* of the middle rail 26.

Figure 3:
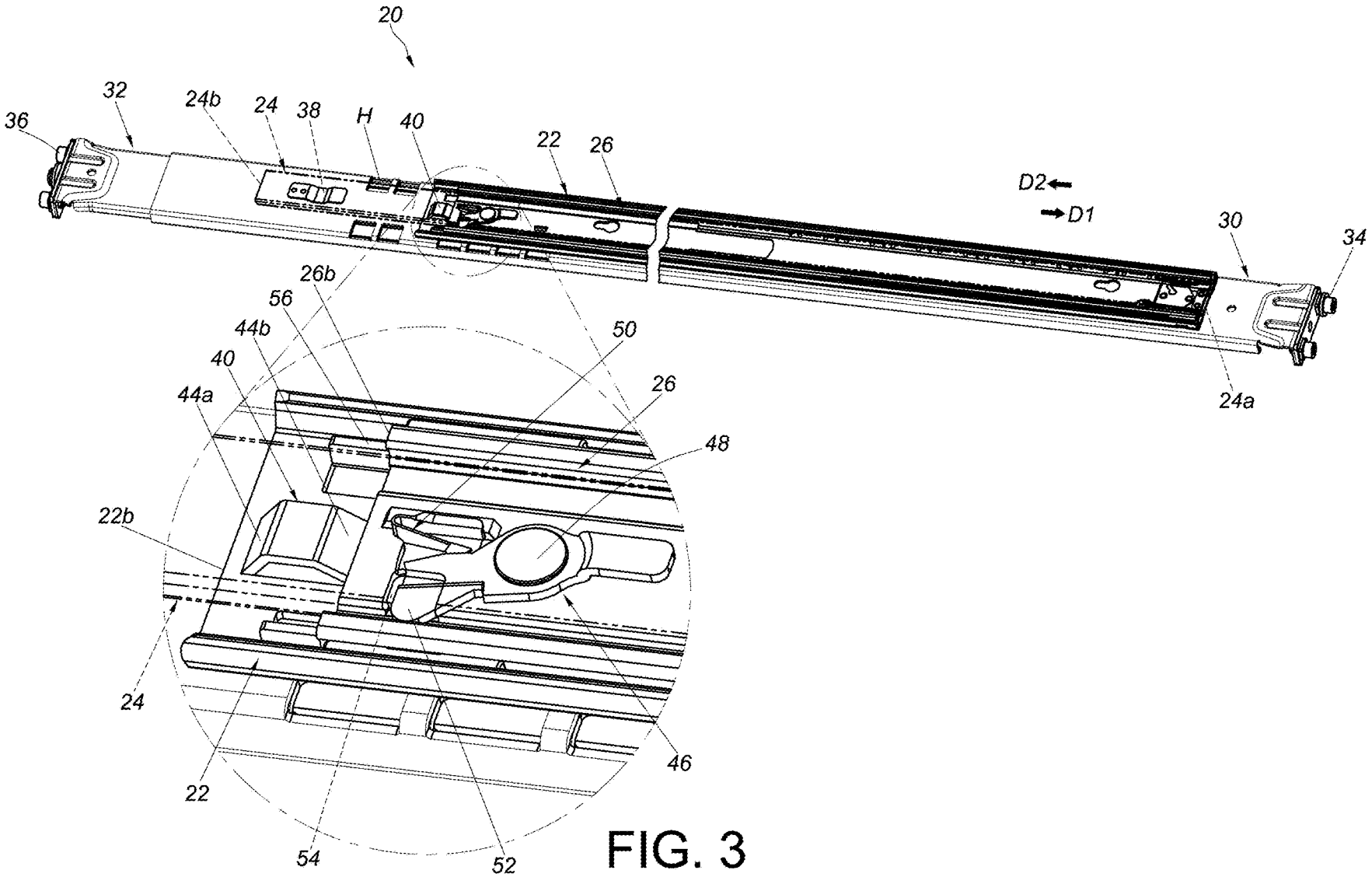
FIG. 3 is a diagram showing the inner rail and the middle rail synchronously movable relative to the outer rail along a predetermined direction through a synchronization mechanism according to the first embodiment of the present invention.

As shown in FIG. 3, the inner rail 24 and the middle rail 26 are configured to be synchronously moved relative to the outer rail 22 along a predetermined direction D1 through the synchronization mechanism. Specifically, the working feature 54 and the auxiliary part 52 of the auxiliary member 46 are configured to be engaged with each other, such that the inner rail 24 and the middle rail 26 can be synchronously moved relative to the outer rail 22 along the predetermined direction D1 (such as an opening direction). The first predetermined feature 38 and the second predetermined feature 40 are separated from each other by a predetermined longitudinal distance along the longitudinal direction.

Preferably, the outer rail 22 is further arranged with at least one blocking part 56 located adjacent to the second end part 22*b* of the outer rail 22 in order to block the second end part 26*b* of the middle rail 26, so as to prevent the middle rail 26 from being moved along another predetermined direction D2 (such as a retracting direction) opposite to the predetermined direction D1.

Figure 4:
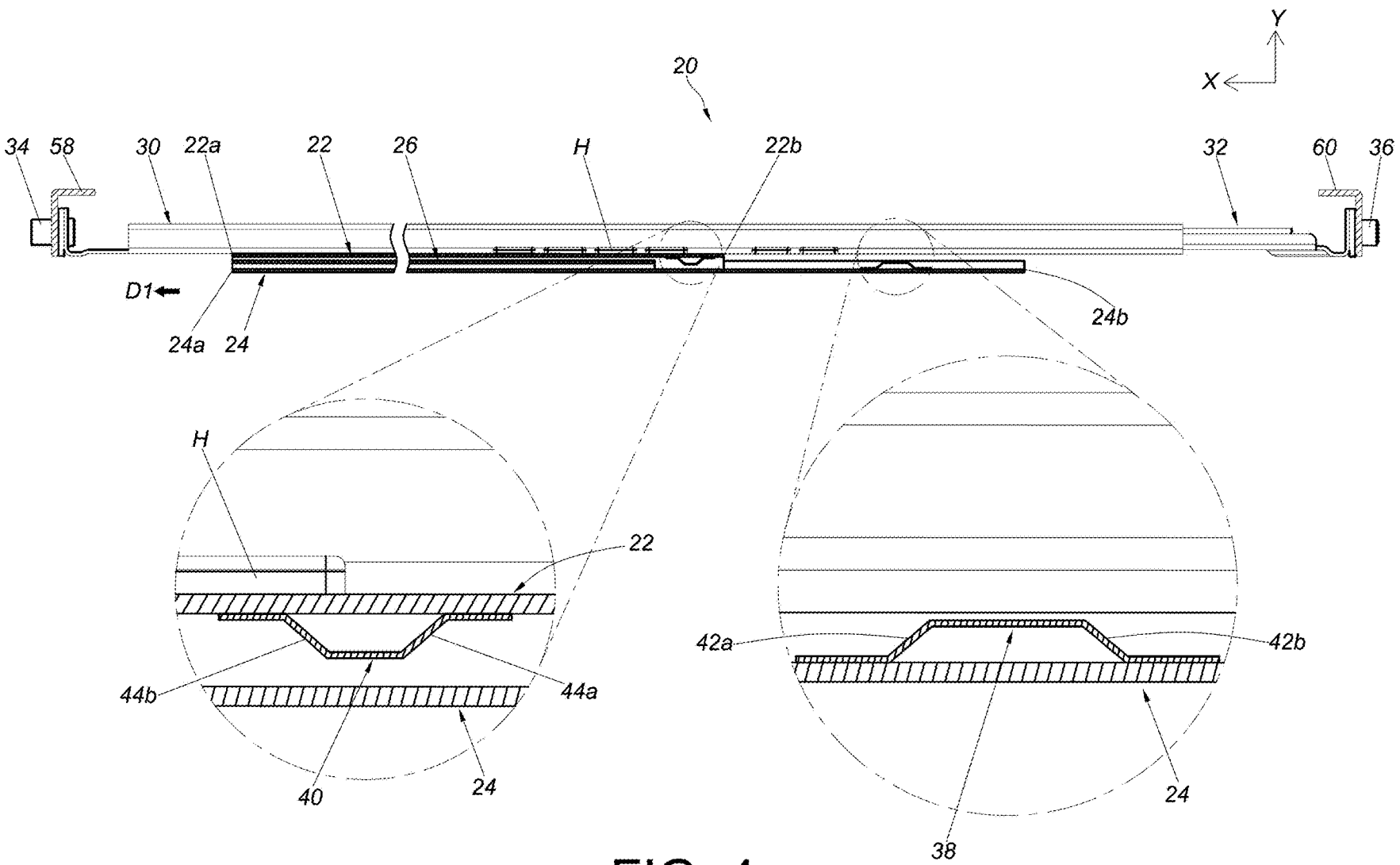
FIG. 4 is a diagram showing the slide rail assembly configured to be mounted to a rack with the inner rail and the middle rail being movable relative to the outer rail along the predetermined direction according to the first embodiment of the present invention.

As shown in FIG. 4, the slide rail assembly 20 is applicable to a rack. Furthermore, the first bracket 30 (the first mounting members 34 of the first bracket 30) and the second bracket 32 (the second mounting members 36 of the second bracket 32) are configured to be mounted to a first post 58 and a second post 60 of the rack respectively, in order to mount the outer rail 22 to the rack. Moreover, the slide rail assembly 20 is in a retracted state, and the inner rail 24 and the middle rail 26 are retracted relative to the outer rail 22. The inner rail 24 and the middle rail 26 are configured to be synchronously moved along the predetermined direction D1 relative to the outer rail 22 through the synchronization mechanism (the synchronization mechanism is omitted in FIG. 4). The first predetermined feature 38 and the second predetermined feature 40 are separated from each other by the predetermined longitudinal distance along the longitudinal direction.

Figure 5:
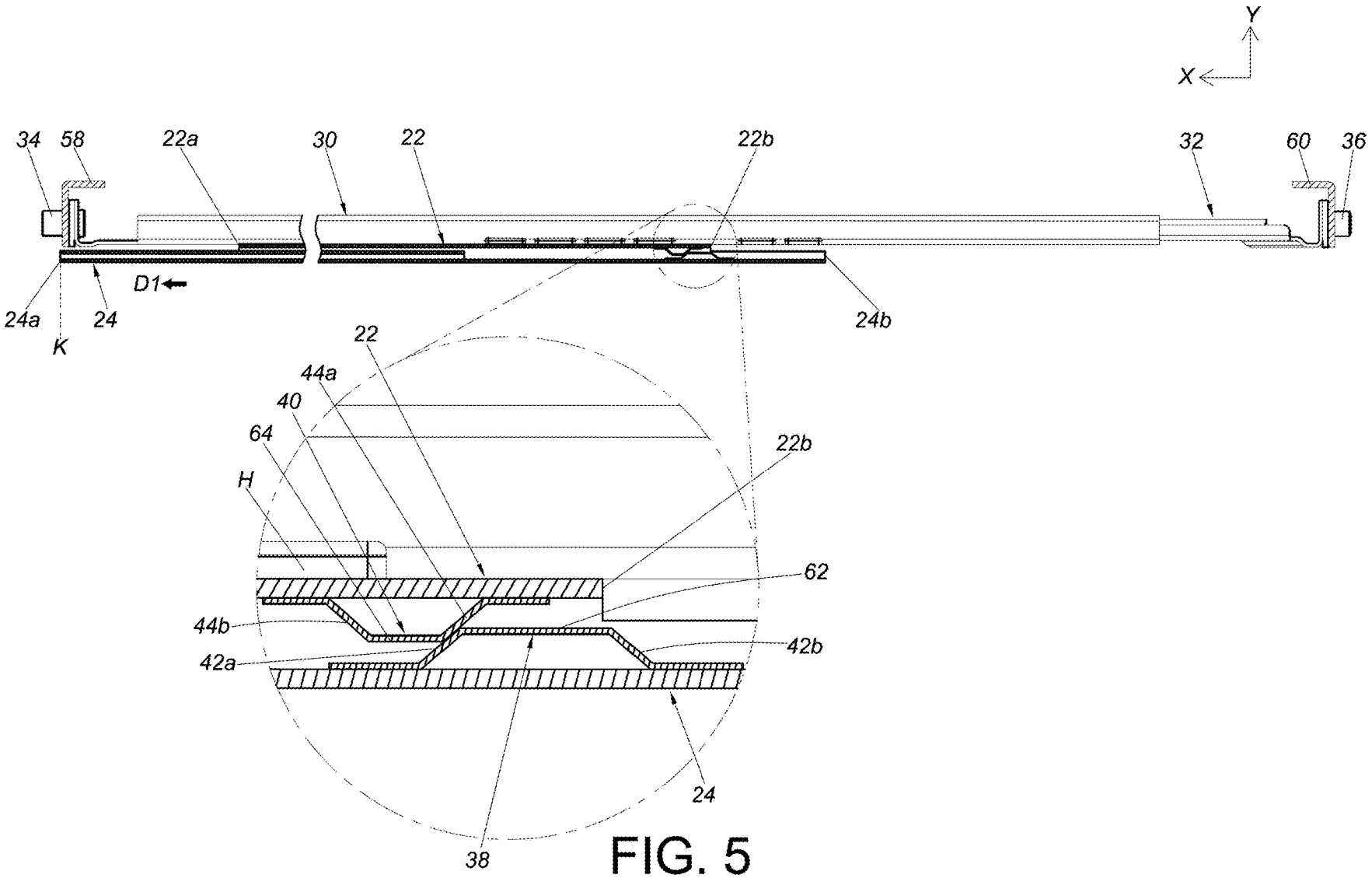
FIG. 5 is a diagram showing the inner rail and the middle rail being moved relative to the outer rail along the predetermined direction according to the first embodiment of the present invention.
Figure 6:
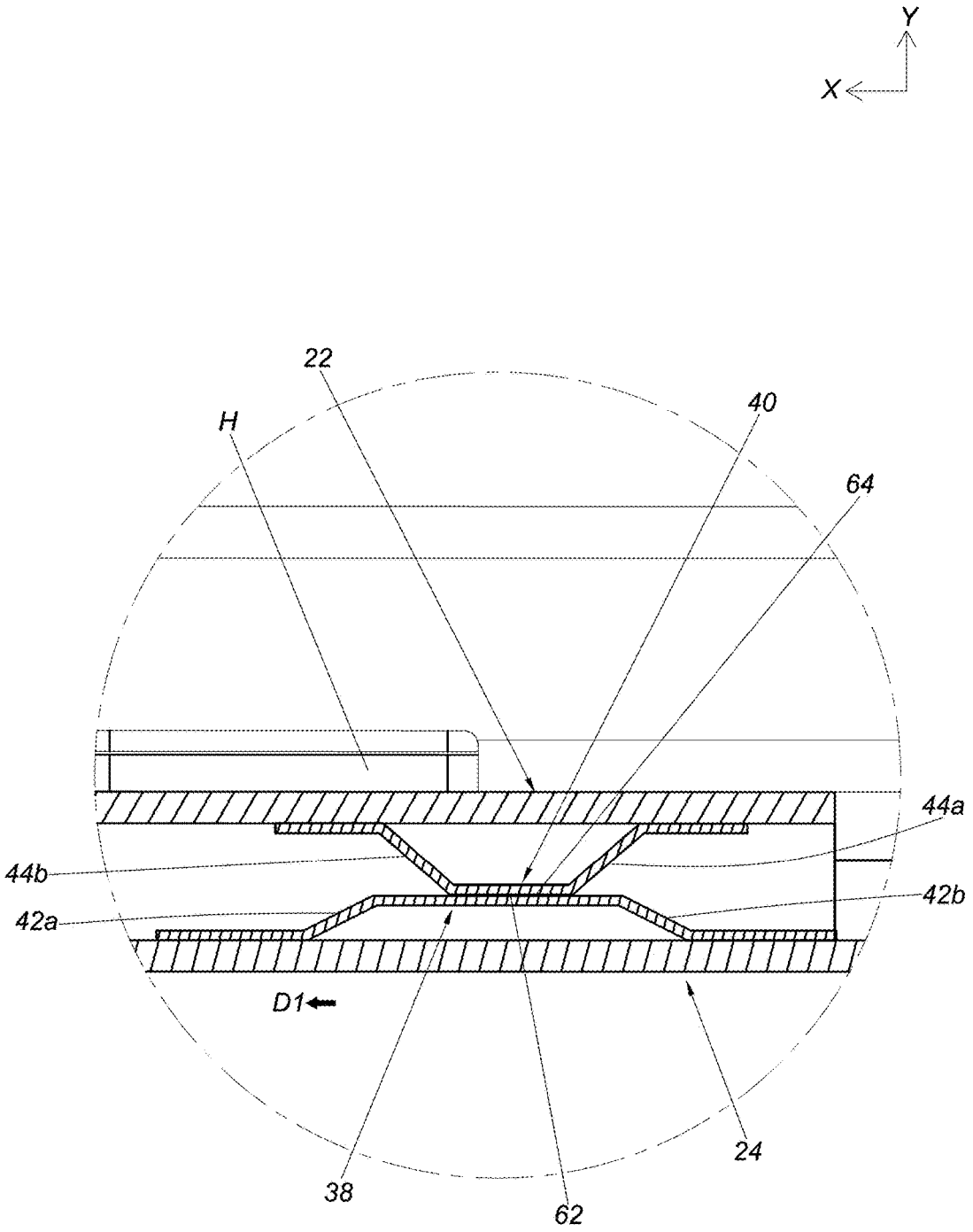
FIG. 6 is a diagram showing the inner rail and the middle rail being further moved relative to the outer rail along the predetermined direction according to the first embodiment of the present invention.
Figure 7:
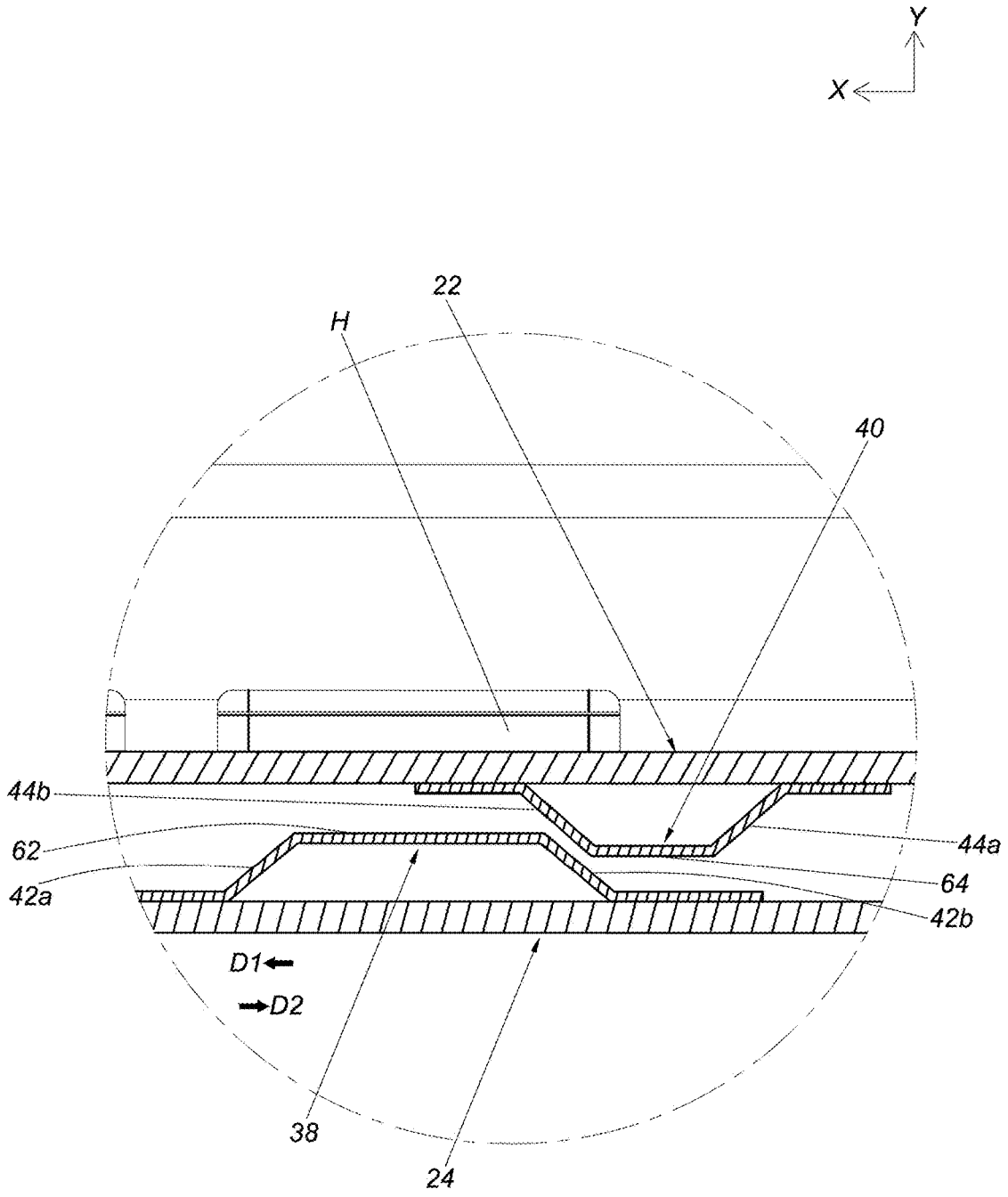
FIG. 7 is a diagram showing the inner rail and the middle rail being further moved relative to the outer rail along the predetermined direction according to the first embodiment of the present invention.

As shown in FIG. 5 to FIG. 7, during a process of the inner rail 24 being moved along the predetermined direction D1 relative to the outer rail 22, the first predetermined feature 38 and the second predetermined feature 40 are configured to contact each other, in order to slow down movement of the inner rail 24 relative to the outer rail 22 along the predetermined direction D1.

Specifically, during the processing of the inner rail 24 being moved along the predetermined direction D1 relative to the outer rail 22, the first guiding surface 42*a* of the first predetermined feature 38 and the first guiding structure 44*a* of the second predetermined feature 40 are configured to contact each other in order to provide resistance to the inner rail 24 (as shown in FIG. 5). If the movement of the inner rail 24 along the predetermined direction D1 is very slow, or a force applied to the inner rail 24 along the predetermined direction D1 is smaller than the resistance, the inner rail 24 is configured to be stopped at a temporary position K by the resistance (as shown in FIG. 5). In other words, the inner rail 24 is no longer moved along the predetermined direction D1, such that the inner rail 24 is stopped at the temporary position K relative to the outer rail 22.

Moreover, if the movement of the inner rail 24 along the predetermined direction D1 is faster, or the force applied to the inner rail 24 along the predetermined direction D1 is greater than the resistance, the inner rail 24 is configured to be further moved along the predetermined direction D1 from the temporary position K relative to the outer rail 22. During such moving process of the inner rail 24, a first surface 62 of the first predetermined feature 38 and a second surface 64 of the second predetermined feature 40 are configured to contact each other in order to provide resistance to the inner rail 24 due to friction (as shown in FIG. 6) until the first predetermined feature 38 crosses over the second predetermined feature 40 along the predetermined direction D1 (as shown in FIG. 7).

Therefore, the first predetermined feature 38 and the second predetermined feature 40 are configured to contact each other to provide resistance to the inner rail 24 due to friction, so as to slow down the movement of the inner rail 24 along the predetermined direction D1 relative to the outer rail 22, in order to avoid impact caused by the excessively fast moving speed of the inner rail 24 along the predetermined direction D1, such that safety and/or protection is improved.

Moreover, as shown in FIG. 7, during a process of the inner rail 24 being moved from an extended position along the predetermined direction D2 relative to the outer rail 22, the second guiding surface 42*b* of the first predetermined feature 38 and the second guiding structure 44*b* of the second predetermined feature 40 are configured to contact each other in order to provide resistance to the inner rail 24, so as to slow down the movement of the inner rail 24 relative to the outer rail 22 along the predetermined direction D2. During a process of the inner rail 24 being further moved along the predetermined direction D2 relative to the outer rail 22, the first surface 62 of the first predetermined feature 38 and the second surface 64 of the second predetermined feature 40 are configured to contact each other in order to provide resistance to the inner rail 24 due to friction (please also refer to FIG. 6) until the first predetermined feature 38 crosses over the second predetermined feature 40 along the predetermined direction D2. As such, the moving speed of the inner rail 24 along the predetermined direction D2 relative to the outer rail 22 is reduced, in order to avoid impact caused by the excessively fast moving speed of the inner rail 24 (and the carried object carried by the inner rail 24) along the predetermined direction D2, such that safety and/or protection is improved.

Figure 8:
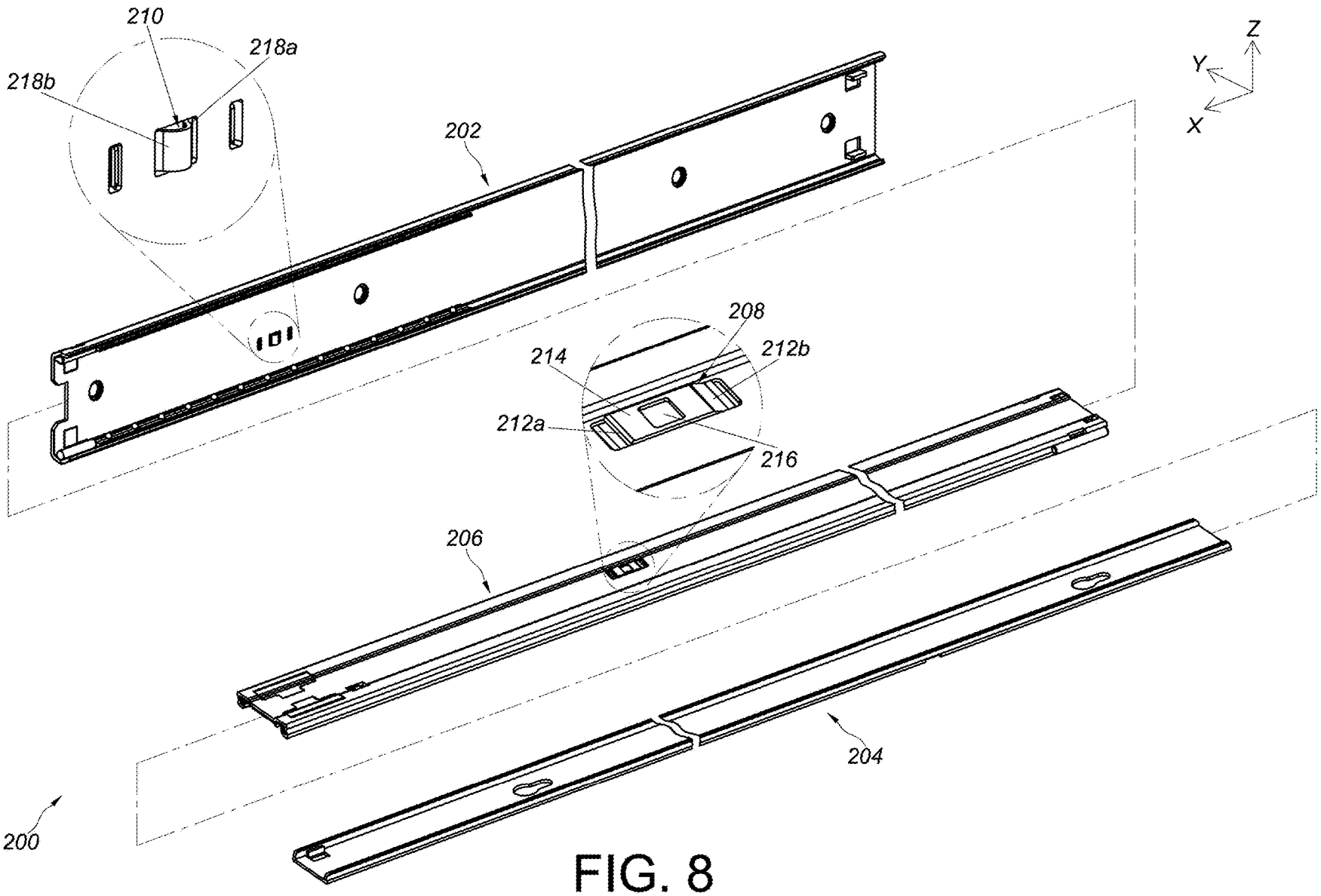
FIG. 8 is an exploded view of the slide rail assembly according to a second embodiment of the present invention.

As shown in FIG. 8, a slide rail assembly 200 comprises an outer rail 202, an inner rail 204 and a middle rail 206 movably mounted between the outer rail 202 and the inner rail 204 according to a second embodiment of the present invention. Different from the first embodiment having the first predetermined feature 38 and the second predetermined feature 40 respectively arranged on the inner rail 24 and the outer rail 22, the second embodiment has a first predetermined feature 208 and a second predetermined feature 210 respectively arranged on the middle rail 206 and the outer rail 204.

Furthermore, the first predetermined feature 208 (such as an elastic object like a spring or a gasket, but the present invention is not limited thereto) has a first guiding surface 212*a* and a second guiding surface 212*b* opposite to each other. Preferably, the first predetermined feature 208 further has a middle part 214 connected between the first guiding surface 212*a* and the second guiding surface 212*b*, and the middle part 214 is formed with a working space 216. Each of the first guiding surface 212*a* and the second guiding surface 212*b* can be an inclined surface or an arc surface. The middle part 214 has a substantially plane surface, and the working space 216 can be a hole or a groove. On the other hand, the second predetermined feature 210 (such as an elastic piece, but not the present invention is not limited thereto) has a first guiding structure 218*a* and a second guiding structure 218*b* opposite to each other. Preferably, each of the first guiding structure 218*a* and the second guiding structure 218*b* has an inclined surface or an arc surface.

Figure 9:
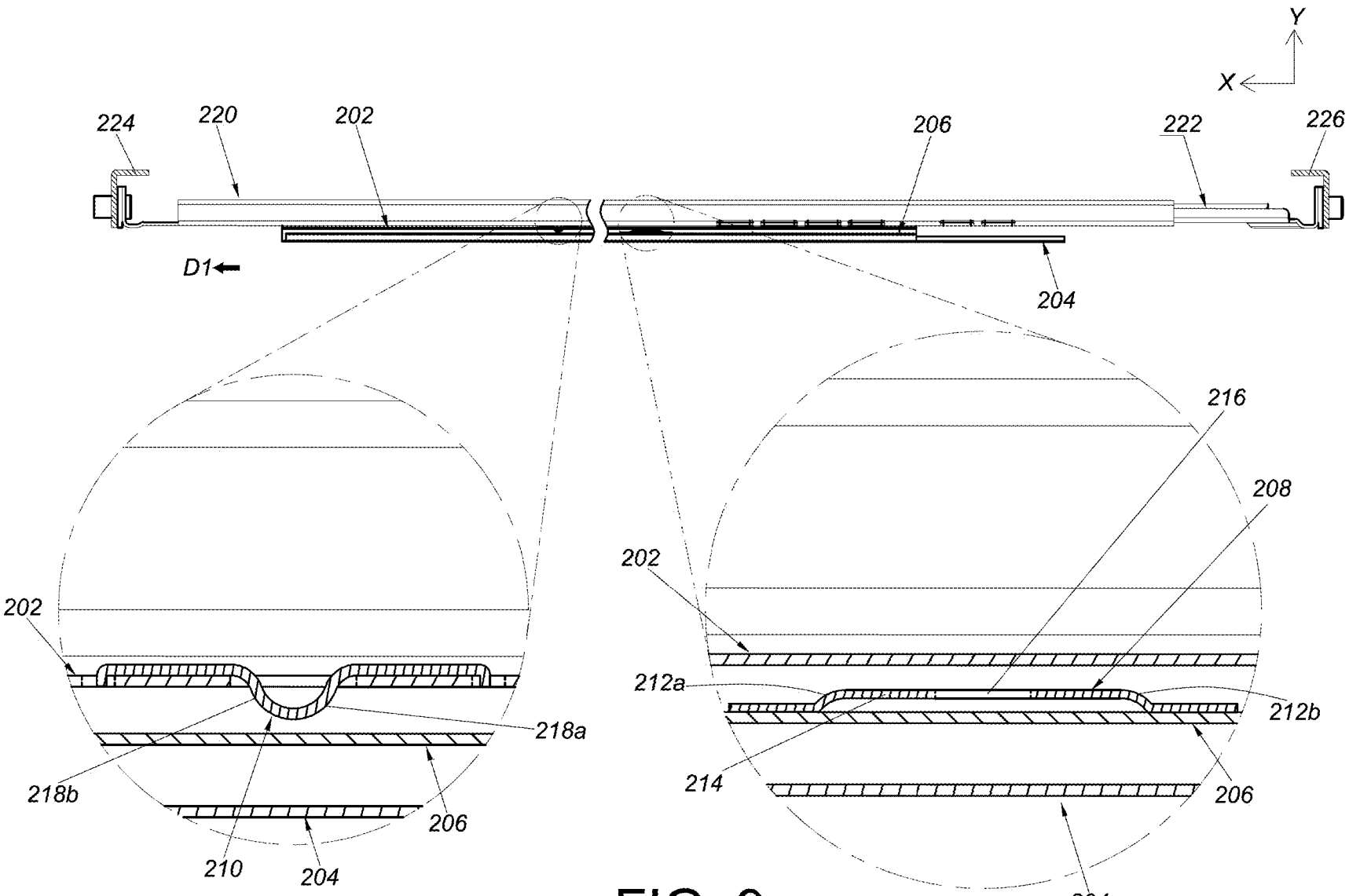
FIG. 9 is a diagram showing the slide rail assembly in a retracted state configured to be mounted to a rack according to the second embodiment of the present invention.

As shown in FIG. 9, similar to the first embodiment, the outer rail 202 is configured to be mounted to a first post 224 and a second post 226 of a rack through a first bracket 220 and a second bracket 222. The slide rail assembly 200 is in a retracted state, the inner rail 204 and the middle rail 206 are retracted relative to the outer rail 202, and the first predetermined feature 208 and the second predetermined feature 210 are separated from each other by a predetermined longitudinal distance along the longitudinal direction.

As shown in FIG. 10 to FIG. 13, during a process of the middle rail 206 being moved (being synchronously moved with the inner rail 204) along the predetermined direction D1 relative to the outer rail 22, the first predetermined feature 208 and the second predetermined feature 210 are configured to contact each other in order to slow down movement of the middle rail 206 relative to the outer rail 202 along the predetermined direction D1.

Figure 10:
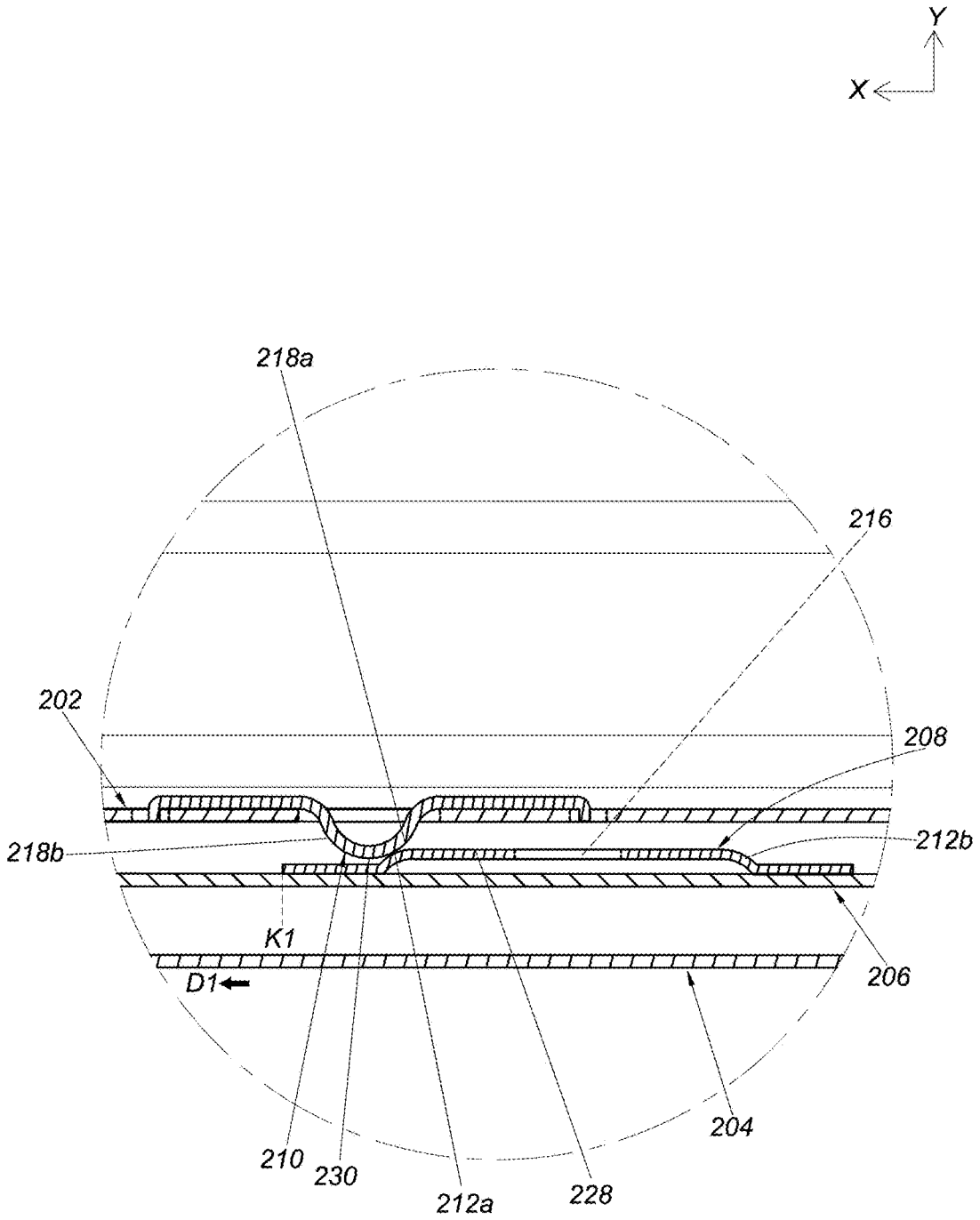
FIG. 10 is a diagram showing the middle rail and the inner rail being moved relative to the outer rail along the predetermined direction according to the second embodiment of the present invention.

Specifically, during the processing of the middle rail 206 being moved along the predetermined direction D1 relative to the outer rail 202, the first guiding surface 212*a* of the first predetermined feature 208 and the first guiding structure 218*a* of the second predetermined feature 210 are configured to contact each other in order to provide resistance to the middle rail 206 (as shown in FIG. 10). If the movement of the middle rail 206 along the predetermined direction D1 is very slow, or a force applied to the inner rail 204 along the predetermined direction D1 is smaller than the resistance, the inner rail 206 is configured to be stopped at a temporary position K1 by the resistance (as shown in FIG. 10).

Figure 11:
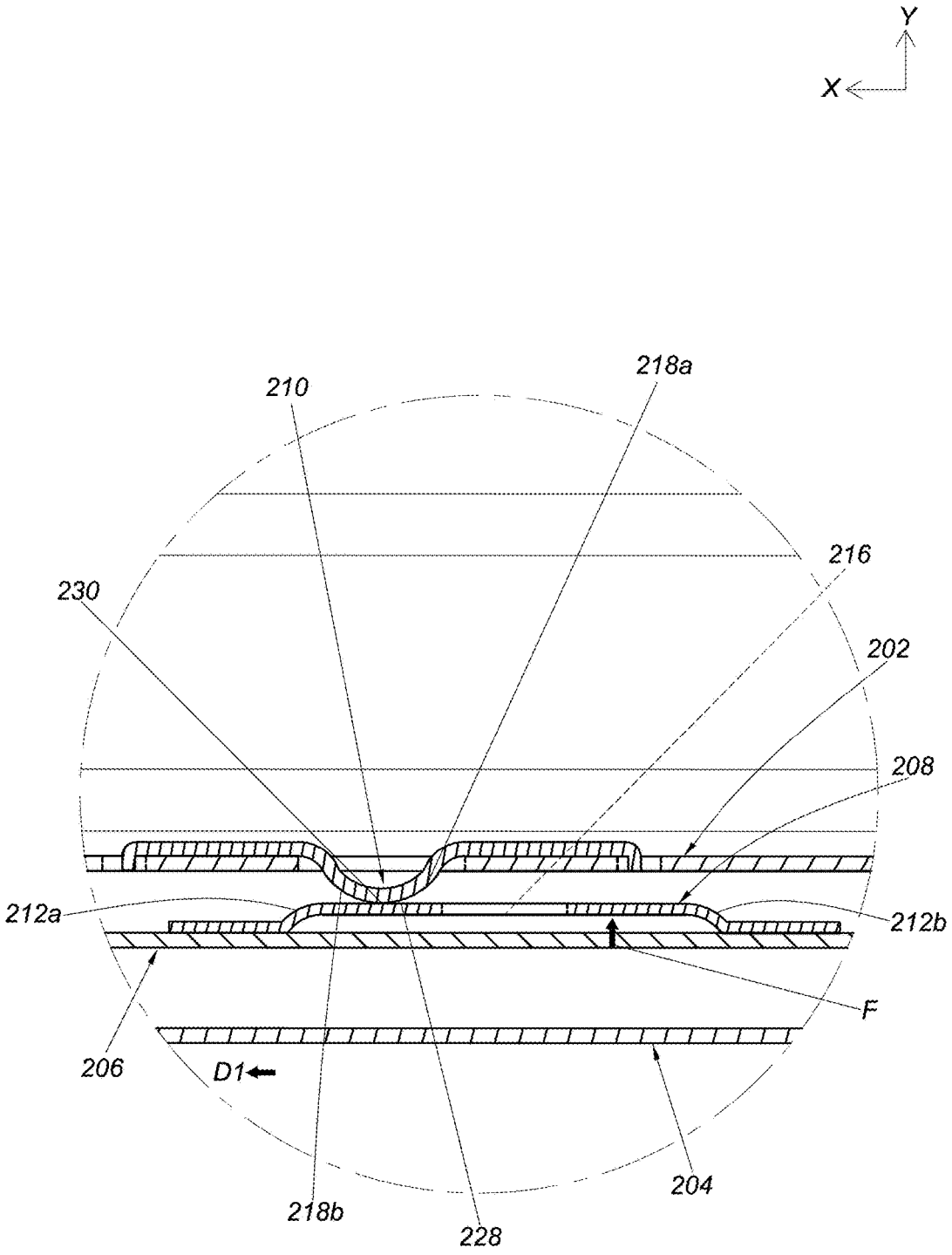
FIG. 11 is a diagram showing the middle rail and the inner rail being further moved relative to the outer rail along the predetermined direction according to the second embodiment of the present invention.
Figure 12:
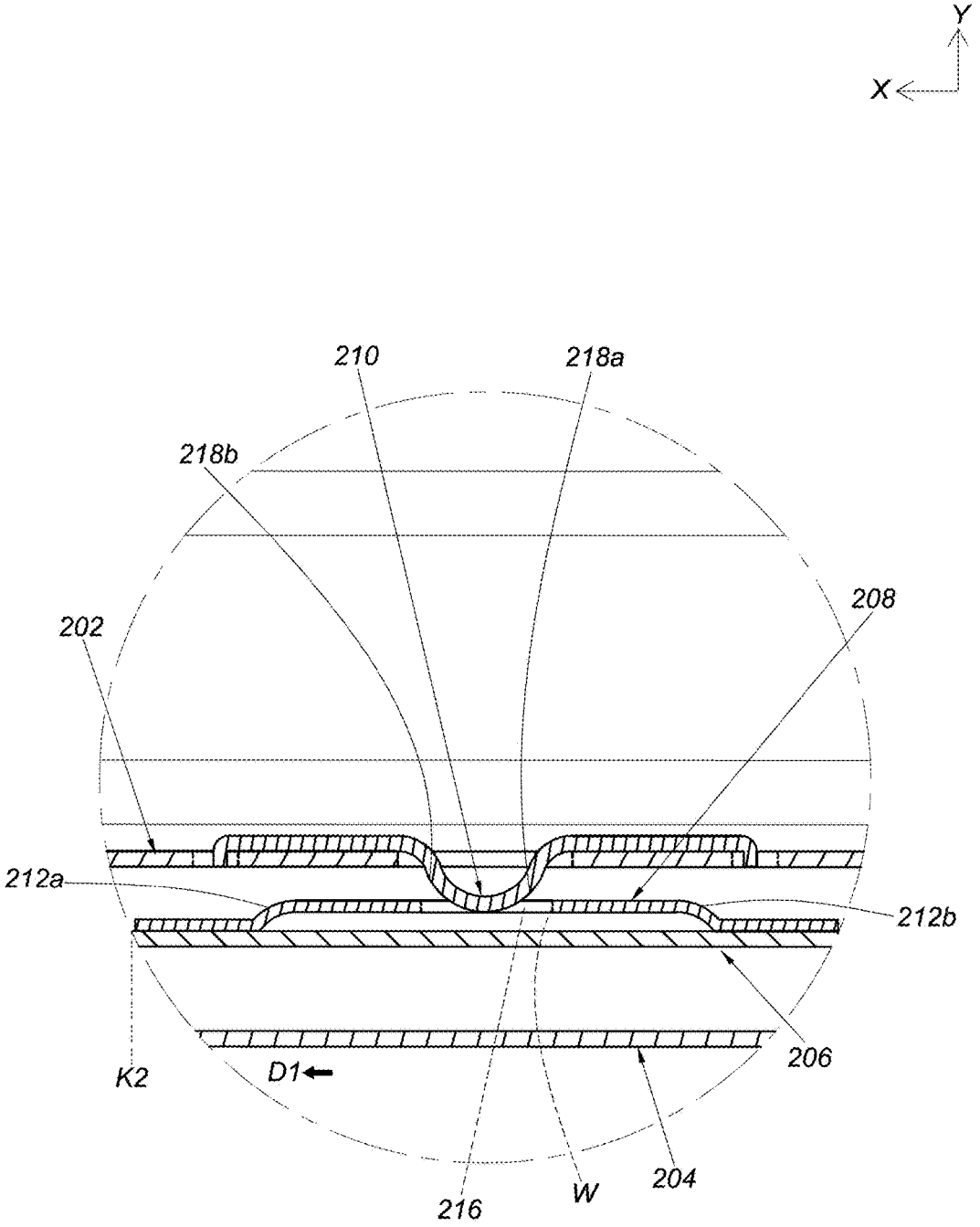
FIG. 12 is a diagram showing the middle rail and the inner rail being further moved relative to the outer rail along the predetermined direction according to the second embodiment of the present invention.

Moreover, if the movement of the middle rail 206 along the predetermined direction D1 is faster, or the force applied to the inner rail 204 along the predetermined direction D1 is greater than the resistance, the middle rail 206 is configured to be further moved along the predetermined direction D1 from the temporary position K1 relative to the outer rail 22. During such moving process of the middle rail 206, a first surface 228 of the first predetermined feature 208 and a second surface 230 of the second predetermined feature 210 are configured to contact each other in order to provide resistance to the middle rail 206 due to friction. In the meantime, the first predetermined feature 208 is pressed by the second predetermined feature 210 to be in a state of accumulating a predetermined elastic force F (as shown in FIG. 11). When the second predetermined feature 210 is located at a position corresponding to the working space 216, the first predetermined feature 208 is configured to release the predetermined elastic force F, such that the second predetermined feature 208 is configured to be extended into the working space 216 (as shown in FIG. 12). Accordingly, the middle rail 206 is configured to be stopped at a predetermined position K2. In other words, the middle rail 206 is stopped at the predetermined position K2 relative to the outer rail 202.

During a process of the middle rail 206 being further moved from the predetermined position K2 along the predetermined direction D1 relative to the outer rail 202, the first guiding structure 218*a* of the second predetermined feature 210 is configured to assist an inner wall W of the working space 216 in passing through the second predetermined feature 210 along the predetermined direction D1 (as shown in FIG. 12). As such, the entire first predetermined feature 208 can be further moved along the predetermined direction D1 to cross over the second predetermined feature 210 (as shown in FIG. 13).

Therefore, the first predetermined feature 208 and the second predetermined feature 210 are configured to contact each other to provide resistance to the middle rail 206 due to friction, so as to slow down the movement of the middle rail 206 relative to the outer rail 202 along the predetermined direction D1, in order to avoid impact caused by the excessively fast moving speed of the middle rail 206 and/or the inner rail 204 (and the carried object carried by the inner rail 204) along the predetermined direction D1, such that safety and/or protection is improved. In addition, after the first predetermined feature 208 crosses over the second predetermined feature 210 along the predetermined direction D1 (as shown in FIG. 13), the inner rail 204 and the middle rail 206 are configured to be synchronously moved relative to the outer rail 202 along the predetermined direction D1 through a synchronization mechanism. Such synchronization mechanism is substantially identical to that of the first embodiment, no further illustration is provided for simplification.

Figure 13:
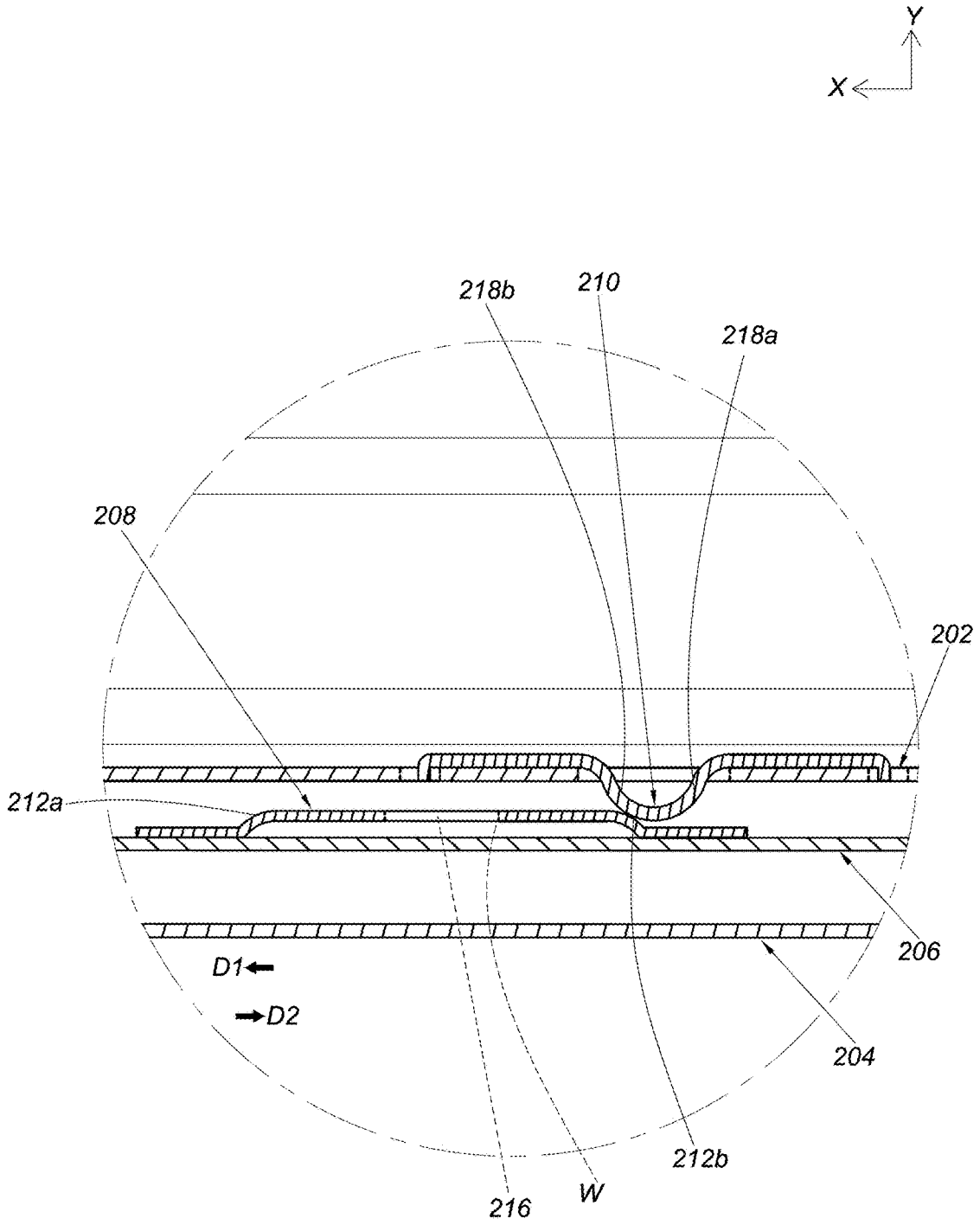
FIG. 13 is a diagram showing the middle rail and the inner rail being further moved relative to the outer rail along the predetermined direction according to the second embodiment of the present invention.

Moreover, as shown in FIG. 13, during a process of the middle rail 206 (and the inner rail 204) being moved from an extended position along the predetermined direction D2 relative to the outer rail 202, the second guiding surface 212*b* of the first predetermined feature 208 and the second guiding structure 218*b* of the second predetermined feature 210 are configured to contact each other to provide resistance to the middle rail 206, so as to slow down the movement of the middle rail 206 relative to the outer rail 202 along the predetermined direction D2. During a process of the middle rail 206 (and the inner rail 204) being further moved along the predetermined direction D2 relative to the outer rail 202, the first surface 228 of the first predetermined feature 208 and the second surface 230 of the second predetermined feature 210 are configured to contact each other in order to provide resistance to the middle rail 206 due to friction (please also refer to FIG. 11) until the first predetermined feature 208 crosses over the second predetermined feature 210 along the predetermined direction D2. As such, the moving speed of the middle rail 206 along the predetermined direction D2 relative to the outer rail 202 is reduced, in order to avoid impact caused by the excessively fast moving speed of the middle rail 206 and/or the inner rail 204 (and the carried object carried by the inner rail 204) along the predetermined direction D2, such that safety and/or protection is improved.

Therefore, the slide rail assembly (20, 200) according to the embodiments of the present invention has the following technical features: the first predetermined feature (38, 208) and the second predetermined feature (40, 210) are configured to contact each other in order to slow down the movement of the inner rail (24,204) or the middle rail (26, 206) relative to the outer rail (22, 202) along the predetermined direction D1, such that the impact caused by the excessively fast moving speed of the inner rail (22, 204) (and the carried object) along the predetermined direction D1 can be avoided, so as to improve safety and/or protection.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly, comprising:

an outer rail having a front end part and a rear end part;

a middle rail movable relative to the outer rail and having a front end part and a rear end part; and an inner rail movable relative to the middle rail and having a front end part and a rear end part;

wherein the middle rail is movably mounted between the outer rail and the inner rail;

wherein the inner rail is arranged with a first predetermined feature adjacent to the rear end part of the inner rail, and the outer rail is arranged with a second predetermined feature adjacent to the rear end part of the outer rail;

wherein during a process of the inner rail being moved along an opening direction relative to the outer rail, the first predetermined feature and the second predetermined feature are configured to contact each other in order to slow down movement of the inner rail along the opening direction relative to the outer rail;

wherein the slide rail assembly further comprises a synchronization mechanism comprising an auxiliary member movably mounted on the middle rail; wherein when the slide rail assembly is in a retracted state, the auxiliary member is configured to be engaged with a working feature of the inner rail, such that the inner rail is configured to drive the middle rail to synchronously move along the opening direction during the process of the inner rail being moved along the opening direction relative to the outer rail;

wherein when the slide rail assembly is in the retracted state, the rear end part of the inner rail is extended beyond the rear end part of the outer rail along a retracting direction, such that the first predetermined feature and the second predetermined feature are separated from each other by a predetermined longitudinal distance along a longitudinal direction of the slide rail assembly, and the rear end part of the outer rail is located between the first predetermined feature and the second predetermined feature along the longitudinal direction of the slide rail assembly.

2. The slide rail assembly of claim 1, wherein the first predetermined feature has a first guiding surface; wherein during the process of the inner rail being moved along the opening direction relative to the outer rail, the first predetermined feature and the second predetermined feature are configured to contact each other through the first guiding surface in order to slow down the movement of the inner rail along the opening direction relative to the outer rail.

3. The slide rail assembly of claim 2, wherein the first predetermined feature further has a second guiding surface opposite to the first guiding surface; wherein during a process of the inner rail being moved from an extended position along the retracting direction relative to the outer rail, the first predetermined feature and the second predetermined feature are configured to contact each other through the second guiding surface in order to slow down the movement of the inner rail along the retracting direction relative to the outer rail.

4. The slide rail assembly of claim 1, wherein the auxiliary member is adjacent to the rear end part of the middle rail.

5. The slide rail assembly of claim 4, wherein when the slide rail assembly is in the retracted state, the rear end part of the outer rail is extended beyond the rear end part of the middle rail along the retracting direction, such that the rear end part of the middle rail is located between the second predetermined feature and the auxiliary member.

* * * * *